US006070847A

United States Patent [19]

Kirchner

[11] Patent Number: 6,070,847

[45] Date of Patent: Jun. 6, 2000

[54] PICTURE HANGING DEVICE

[76] Inventor: Richard N. Kirchner, 11204 Gasch, Harvard, Ill. 60033

[21] Appl. No.: 09/229,916

[22] Filed: Jan. 13, 1999

[51] Int. Cl.[7] ..... A47G 1/24; A47G 1/16; A47F 7/14; F16H 27/02

[52] U.S. Cl. ..... 248/480; 248/488; 40/761; 74/89.15

[58] Field of Search ..... 248/476, 488, 248/489, 475.1, 479, 480, 498, 495, 466, 490, 494, 497, 477, 478; 40/745, 747, 757, 759, 761, 762; 74/89.15; 411/376, 480, 377; 403/326

[56] References Cited

U.S. PATENT DOCUMENTS

| | | | |
|---|---|---|---|
| 539,015 | 5/1895 | Fontneau | 403/326 |
| 703,704 | 7/1902 | Hofmann | 411/480 |
| 779,433 | 1/1905 | Long | 248/495 |
| 938,768 | 11/1909 | Kenny | 52/220.1 |
| 989,612 | 4/1911 | Kohn | 248/495 |
| 1,060,708 | 5/1913 | Reynolds | 248/495 |
| 1,485,281 | 2/1924 | McGowan | 248/489 |
| 1,909,353 | 5/1933 | Hughes et al. | 403/326 |
| 2,065,335 | 12/1936 | Calhoun | 24/625 |
| 2,354,622 | 7/1944 | Swartz | 40/800 |
| 2,438,436 | 3/1948 | Graves | 248/490 |
| 2,503,854 | 4/1950 | Trainor | 403/223 |
| 2,614,778 | 10/1952 | Graves | 248/490 |
| 3,345,114 | 10/1967 | Vass | 403/256 |
| 4,162,056 | 7/1979 | Moorhead | 248/495 |
| 4,222,544 | 9/1980 | Crowder | 248/495 |
| 4,233,764 | 11/1980 | Small | 248/489 |
| 4,428,135 | 1/1984 | Sobel | 40/155 |
| 4,645,165 | 2/1987 | Raap | 248/476 |
| 4,653,721 | 3/1987 | Bachmann et al. | 251/88 |
| 4,892,284 | 1/1990 | Kelrick | 248/495 |
| 4,932,146 | 6/1990 | Long | 40/156 |
| 5,100,094 | 3/1992 | Handwerger et al. | 248/489 |
| 5,669,593 | 9/1997 | Kirchner | 248/489 |
| 5,806,826 | 9/1998 | Lemire | 248/476 |

*Primary Examiner*—Anita M. King
*Assistant Examiner*—Michael Nornberg
*Attorney, Agent, or Firm*—Mathew R. P. Perrone, Jr.

[57] ABSTRACT

A hanging device has a wall mount and an adjustable picture mounting device to be placed on the item to be hung. The adjustable mechanism can be threadably or frictionally positioned.

13 Claims, 3 Drawing Sheets

PICTURE HANGING DEVICE

This invention relates to a picture hanging device, and more particularly to a picture hanging device that can be adjusted in order to hang the picture in a proper position.

BACKGROUND OF THE INVENTION

A certain degree of skill is required to hang a picture, so that it is substantially parallel and square with the wall on which it was mounted. This requires a certain degree of skill in mounting the picture and having it achieve the desired position.

Many hanging devices for pictures or other wall ornaments are known. Some devices provide for adjusting the position of the picture after mounting on the wall. Other devices require careful positioning of any hanging device on an item to be hung. It very desirable to improve the efficiency of adjusting the picture, or any item being hung, as to position as it is being mounted on the wall.

For example, an assumption is made that the item to hung is of a generally rectangular shape. The preferred position is to have a first pair of opposing sides of the rectangle parallel to the floor and a second pair of opposing sides of the rectangle perpendicular to the floor.

Applicant's prior invention, as set forth in U.S. Pat. No. 5,669,593, incorporated herein by reference, provides a good description of the difficulties involved in properly hanging a picture or other item on the wall. Such difficulties do not need to be further discussed herein.

Another problem with hanging an item on a wall is that the attachment of the hanging device to the wall is so flexible, that the item may be easily knocked off the wall. It is desirable to solve this problem without permanently attaching the picture, plaque or other item to the wall. Yet these features are counter productive. Maximizing holding power, while reducing wall separation is contrary to avoiding a permanent attachment. It is very desirable to minimize those chances of accidental removal.

SUMMARY OF THE INVENTION

Among the many objectives of this invention is the provision of a hanging device having a wall mount to be attached to a wall and an slidable positioning device to be mounted on a picture or other item to be hung.

Another objective of this invention is to provide a hanging device, wherein the slidable positioning device is frictionally supported.

Yet another objective of this invention is to provide a hanging device wherein the slidable positioning device is threadably supported.

Still another objective of this invention is to provide a hanging device, which is adjustable.

Additionally, an objective of this invention is to provide a hanging device, which permits an item mounted on a wall to have an adjustable position.

Also, an objective of this invention is to provide a hanging device, which can minimize the difficulty in obtaining a precise positioning required for a hanging device.

A further objective of this invention is to provide a hanging device, which is easily installed.

A still further objective of this invention is to provide a hanging device, which permits in place adjustment of an item hung on a wall.

Yet a further objective of this invention is to provide a hanging device, which avoids damage to a wall.

Another objective of this invention is to provide a slidable positioning device as an adjustable picture mounting device.

Yet another objective of this invention is to provide a hanging device wherein the slidable positioning device is threadably supported.

Still another objective of this invention is to provide a hanging device wherein the chance of item hung thereby being accidentally removed therefrom is minimal.

These and other objectives of the invention (which other objectives become clear by consideration of the specification, claims and drawings as a whole) are met by providing a hanging device, including a wall mount and an adjustable picture mounting device to be placed on the item to be hung.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
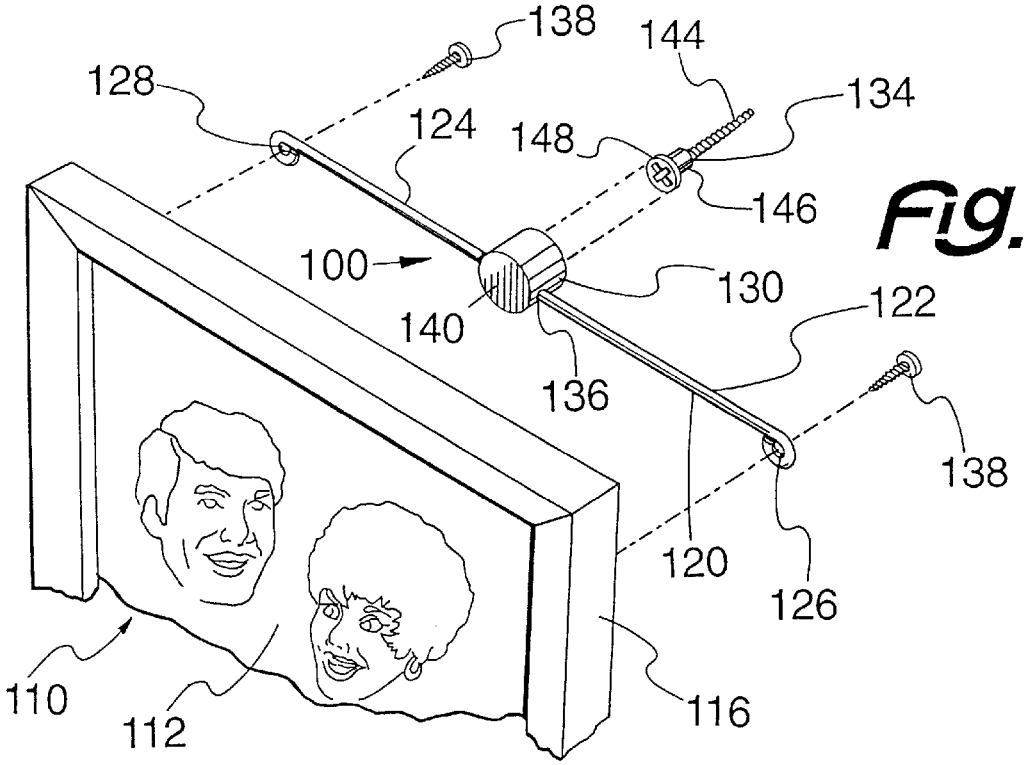
FIG. 1 depicts a front, exploded, perspective view of the slidable hanging device 100 of this invention, with a front view 110 of picture 112.

To hang the picture or other item with the hanging device of this invention, a wall mount is mounted on the wall or other support surface. Also, a frictionally slidable bracket is mounted on the picture or other item to be hung. Alternatively the frictionally slidable bracket is replaced with a threaded bracket. The frictional bracket or the threaded bracket joins with the wall mount to form the hanging device and hang the item attached thereto.

This structure provides for simplified mounting of a picture or other wall ornament. Due to the simplified structure, the frictional mount is preferred.

Referring now to FIG. 1, FIG. 2, FIG. 3 and FIG. 4 the slidable hanging device 100 is secured to a picture 112. The picture hanging device 100 includes a straight wire harness 120. Mounted on the straight wire harness 120 is a slide apertured block 130, which is frictionally positioned on the straight wire harness 120. The straight wire harness 120, while being continuous, appears to be formed into a first rod 122 and a second rod 124 by the slide apertured block 130.

Thus, the slide apertured block 130 divides a continuous rod forming the straight wire harness 120 into the first rod 122 and the second rod 124. At the end of the first rod 122 is a first anchor eyelet 126. At the end of the second rod 124 is a second anchor eyelet 128. Each anchor eyelet is attached to a picture frame 116 of picture 112 or other item desired to be held on the wall 118.

The slide apertured block 130 is preferably and substantially cylindrical in shape. It is mounted on the straight wire harness 120 at slide aperture 136. Slide aperture 136 is of sufficient size to move slide apertured block 130 in frictional relationship with straight wire harness 120. Thus slide aperture 136 permits repositioning of picture 112 after it is mounted on wall 118.

Within the slide apertured block 130 is a rotation groove 132. Into this rotation groove 132, a screw 134 or other holding device may fit. This holding device, exemplified by screw 134 is mounted on the wall 118. With the rotation groove 132 being in slide apertured block 130, and the screw 134 fitting in rotation groove 132, the picture 112 with picture frame 116 may be removably locked onto the wall 118. The picture 112 is then easily positioned by moving the slide apertured block 130 along straight wire harness 120, in order to position picture frame 116 as desired.

A preferred version of screw 134 has threads 144, shank 146, and head 148. Shank 146 provides a spacing between wall 118 and picture frame 116. Threads 144 protrude from one side of shank 146 into wall 118. Head 148 protrudes from shank 146 and is oppositely disposed from threads 144. Head 148 also receives threaded mounting block 204 or slide apertured block 130 in rotation groove 132 in order to mount picture 112.

More particularly, slide apertured block 130 has a closed cylindrical end 140 and an indented cylindrical end 142. Closed end 140 is placed adjacent to picture 114 when mounted. Rotation groove 132 is positioned inside indented cylindrical end 142 and adapted to receive screw 134, by a rotation or snapping mechanism. Also with the rotation groove 132 being so situated in slide block 130, and the head of screw 134 fitting therein, a snap fitting is created. Such a snap fitting provides a removably lockable mounting mechanism.

As can be seen in the drawing figures, the slide aperture 136 is centrally located in the side of slide apertured block 130, which is preferably cylindrical in shape. The geometrical axis for slide aperture 136 is substantially concentric with the axis of the straight wire harness 120, and perpendicular to the cylindrical axis of slide apertured block 130.

Figure 4:
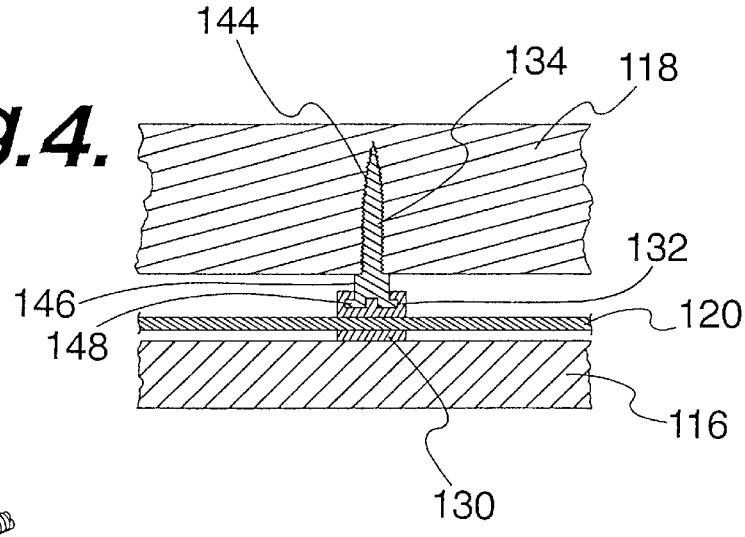
FIG. 4 depicts a rear, plan view of the slidable hanging device 100 of this invention, with a rear view 114 of picture 112.

By adding FIG. 4 to the consideration, the mounting of slidable hanging device 100 on picture 112 from the rear view 114 is shown. Straight wire harness 120 is secured to frame 116 by eyelet screws 138, or other appropriate fasteners. A standard tape measure 108 can assist in centering slide apertured block 130 for the picture 112 by hand 106. Adjustments may also be made after slide apertured block is mounted on the wall 118 (FIG. 1) by wall screw 134.

Figure 5:
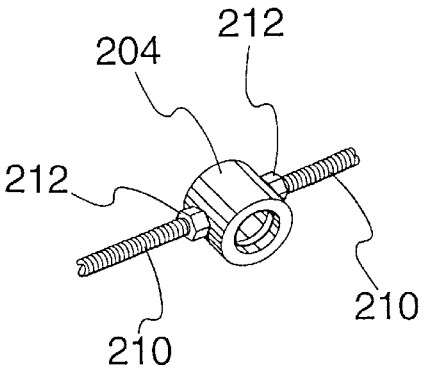
FIG. 5 depicts a perspective view of the threaded hanging device 200 of this invention, from the picture side 202, which in use is adjacent to picture 112.

In FIG. 5, another embodiment is shown. In this particular item or threaded hanging device 200, the movable mounting block 204 is in threaded relation with a threaded rod 210. The threaded rod 210 is positioned within the threaded mounting block 204 by nuts 212 which lock the slide block 200 in the appropriate position.

In a similar fashion, the nuts 212 may also be used as weights to position the picture 112 as desired. With this device, the picture 112 may be mounted on the wall 118 and positioned accordingly by sliding. In this fashion, it is possible to mount the picture 112 with threaded slide bracket 112 on the wall 118 and achieve the desired positioning of the picture so that the picture is held in the desired vertical position.

Alternatively, the slide block may be in threaded relation with the threaded rod 210. Nuts 212 or may not be used. Threading of slide aperture 136 may satisfy this requirement for fixing slide apertured block 130.

Figure 6:
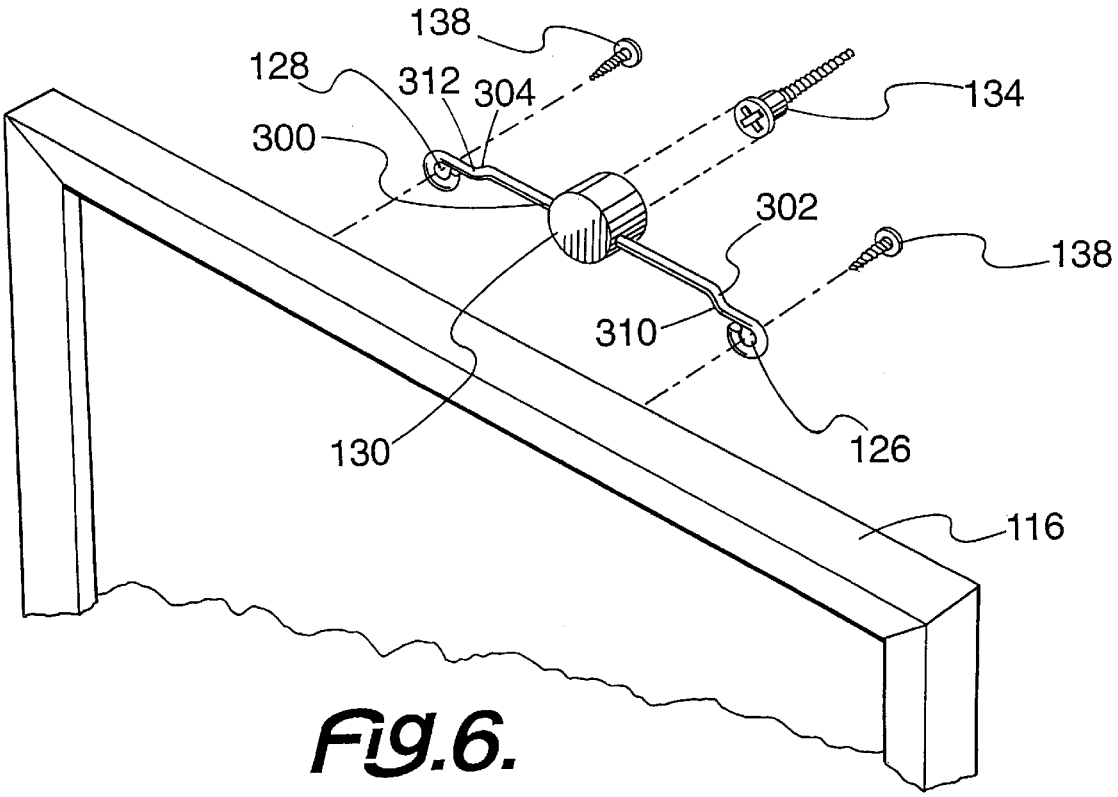
FIG. 6 depicts a front, perspective view of the slidable hanging device 100 of this invention, with an arced wire harness 300.

With FIG. 6 is depicted a preferred, arced, wire harness 300 for the slidable hanging device 100. The picture hanging device 100 is modified to include the arced wire harness 220. Mounted on the arced wire harness 300 is the slide apertured block 130, which is frictionally positioned on the arced wire harness 300. The arced wire harness 300, while being continuous, appears to be formed into a first arced rod 302 and a second arced rod 304 by the slide apertured block 130.

Thus, the slide apertured block 130 divides a continuous rod forming the arced wire harness 300 into the first arced rod 302 and the second arced rod 304. At the end of the first arced rod 302 is the first anchor eyelet 126. At the end of the second arced rod 304 is a second anchor eyelet 128. Each anchor eyelet is attached to a picture frame 116 of picture 112 or other item desired to be held on the wall 118. Like straight wire harness 120, the slide apertured block 130 is mounted on the arced wire harness 300.

On first arced rod 302 between first anchor eyelet 126 and slidable block 130 is first arc 310. On second arced rod 304 between second anchor eyelet 128 and slidable block 130 is second arc 312. Thus arced wire harness 220 has an axis of symmetry perpendicular to its plane.

Arced wire harness 300 may also be threaded as shown in FIG. 5. The threaded portion as can be seen from FIG. 5, is positioned between first arc 310 and second arc 312. Between FIG. 5 and FIG. 6, the structure becomes clear.

Figure 2:
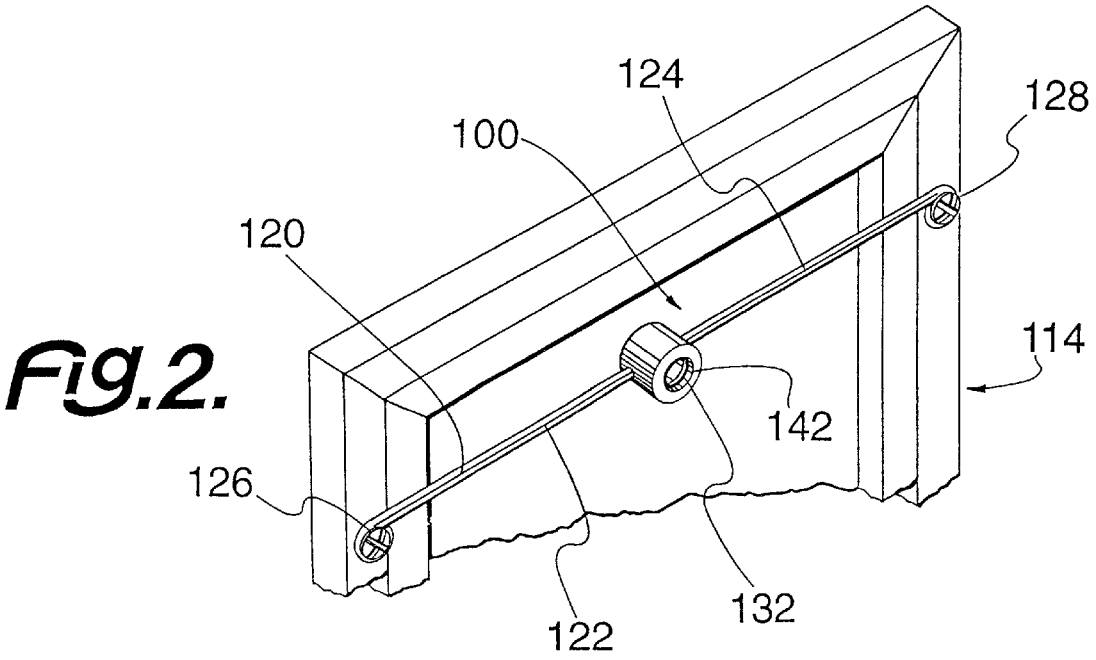
FIG. 2 depicts a rear, perspective view of the slidable hanging device 100 of this invention, with a rear view 114 of picture 112.
Figure 3:
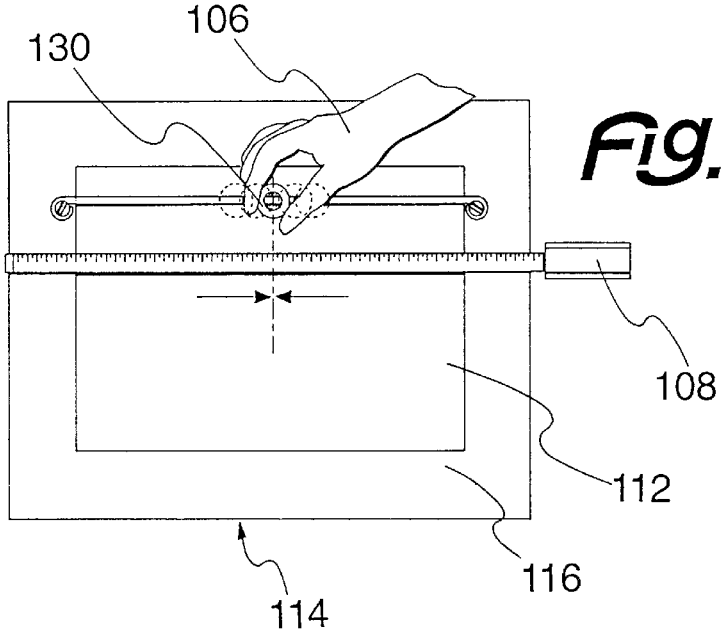
FIG. 3 depicts a top, cross-sectioned view slidable hanging device 100 of this invention for a picture 112.

Arced wire harness 300 may also be as long as straight wire harness 120 and positioned similarly as seen in FIG. 1 and FIG. 2. Likewise straight wire harness 120 may be as short arced wire harness 300 and positioned similarly as shown in FIG. 6.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. A hanging device to support an item on a surface comprising:

(a) a wall mount being adapted to support the item on the surface;

(b) an adjustable mounting device being adapted for placement on the item;

(c) the adjustable mounting device being removably securable to the wall mount;

(d) the adjustable mounting device including a means to adjust a position for the item after securing to the wall mount;

(e) the adjustable mounting device being a slidable bracket;

(f) the slidable bracket including a harness and a slide apertured block;

(g) the harness being adapted for securing to the item;

(h) the slide apertured block being mounted on the harness;

(i) the slide apertured block being adapted to receive the wall mount;

(j) the slide apertured block being movably positionable on the harness due to friction;

(k) the slide apertured block including a snapping means for securing the slide apertured block to the wall mount;

(l) the snapping means including an axial indentation in the slide apertured block and a groove within the axial opening; and (m) the groove being adaptable to snap fit onto the wall mount.

2. The hanging device of claim 1, further comprising:

(a) the slide apertured block being mounted on the harness at a block aperture;

(b) the slide apertured block having a frictional relationship with the block aperture; and (c) the slide apertured block separating the harness into a first rod and a second rod.

3. The hanging device of claim 2, further comprising:

(a) the harness being continuous;

(b) a first anchor eyelet being at an end of the first rod;

(c) a second anchor eyelet being at an end of the second rod; and (d) the first anchor eyelet and the second anchor eyelet being adapted for attachment to the item.

4. The hanging device of claim 3, further comprising:

(a) the slide apertured block having a shape substantially in the form of a cylinder;

(b) the cylinder having a closed cylindrical end and an indented cylindrical end;

(c) the indented cylindrical end having a rotation groove positioned therein; and (d) the rotation groove being adapted to receive a screw by a rotation mechanism or a snapping mechanism.

5. The hanging device of claim 4, further comprising:

(a) the slide apertured block having the slide aperture centrally located in a cylindrical side of the slide apertured block;

(b) a geometrical axis for the slide aperture being substantially concentric with a central axis of the wire harness; and (c) the geometrical axis for the slide aperture being substantially perpendicular to a cylindrical axis of slide apertured block.

6. The hanging device of claim 5, further comprising:

(a) the harness being an arced harness;

(b) the arced harness having a first arced rod and a second arced rod formed by the slide apertured block;

(c) the first arced rod having a first arc between the first eyelet and the slidable block; and (d) the second arced rod having a second arc between the second eyelet and the slidable block.

7. The hanging device of claim 1, further comprising:

(a) the harness having male threads thereon; and (b) the slide apertured block having female threads adapted to cooperate with the male threads.

8. The hanging device of claim 1, further comprising:

(a) the harness having male threads thereon; and (b) a first nut in threaded relation with the male threads on a first side of the slide apertured block;

(c) a second nut in threaded relation with the male threads on a second side of the slide apertured block; and (d) the first side of the slide apertured block being oppositely disposed from the second side of the slide apertured block.

9. A hanging device to support an item on a surface comprising:

(a) a wall mount being adapted to support the item on the surface;

(b) an adjustable mounting device being adapted for placement on the item;

(c) the adjustable mounting device being removably securable to the wall mount;

(d) the adjustable mounting device including a means to adjust a position for the item after securing to the wall mount;

(e) the adjustable mounting device being a slidable bracket positionable with friction;

(f) the slidable bracket including a harness and a slide apertured block;

(g) the slide apertured block cooperating with the harness to make the slidable bracket positionable with friction;

(h) the harness being adapted for securing to the item;

(i) the slide apertured block being mounted on the harness;

(j) the slide apertured block being adapted to receive the wall mount;

(k) the slide apertured block being movably positionable on the harness due to friction;

(l) the slide apertured block including a snapping means for securing the slide apertured block to the wall mount;

(m) the snapping means including an axial indentation in the slide apertured block and a groove within the axial opening; and (n) the groove being adaptable to snap fit onto the wall mount.

10. The hanging device of claim 9, further comprising:

(a) the slide apertured block being mounted on the harness at a block aperture;

(b) the slide apertured block having a frictional relationship with the block aperture;

(c) the slide apertured block separating the harness into a first rod and a second rod;

(d) the harness being continuous;

(e) a first anchor eyelet being at an end of the first rod;

(f) a second anchor eyelet being at an end of the second rod; and (g) the first anchor eyelet and the second anchor eyelet being adapted for attachment to the item.

11. The hanging device of claim 10, further comprising:

(a) the slide apertured block having a shape substantially in the form of a cylinder;

(b) the cylinder having a closed cylindrical end and an indented cylindrical end;

(c) the indented cylindrical end having a rotation groove positioned therein; and (d) the rotation groove being adapted to receive a screw by a rotation mechanism or a snapping mechanism.

12. The hanging device of claim 11, further comprising:

(a) the slide apertured block having the slide aperture centrally located in a cylindrical side of the slide apertured block;

(b) a geometrical axis for the slide aperture being substantially concentric with a central axis of the wire harness; and (c) the geometrical axis for the slide aperture being substantially perpendicular to a cylindrical axis of slide apertured block.

13. The hanging device of claim 12, further comprising:

(a) the harness being an arced harness;

(b) the arced harness having a first arced rod and a second arced rod formed by the slide apertured block;

(c) the first arced rod having a first arc between the first eyelet and the slidable block; and (d) the second arced rod having a second arc between the second eyelet and the slidable block.

* * * * *